US007478651B2

(12) United States Patent
Simpson

(10) Patent No.: US 7,478,651 B2
(45) Date of Patent: Jan. 20, 2009

(54) BORE-LINING TUBING

(75) Inventor: Neil Andrew Abercrombie Simpson, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 251 days.

(21) Appl. No.: 11/467,223

(22) Filed: Aug. 25, 2006

(65) Prior Publication Data

US 2006/0278403 A1 Dec. 14, 2006

Related U.S. Application Data

(62) Division of application No. 10/115,434, filed on Apr. 3, 2002, now abandoned.

(30) Foreign Application Priority Data

Apr. 4, 2001 (GB) ..... 0108384.9

(51) Int. Cl.
*F16L 55/16* (2006.01)

(52) U.S. Cl. ..... 138/98; 138/97; 138/104; 405/150.1; 166/380

(58) Field of Classification Search ..... 138/97, 138/98, 121, 122, 104; 166/380, 277, 207, 166/242.2; 405/47–49, 140, 146, 150.1
See application file for complete search history.

(56) References Cited

U.S. PATENT DOCUMENTS

| | | | | |
|---|---|---|---|---|
| 1,055,674 | A | | 3/1913 | Smith |
| 3,272,517 | A | | 9/1966 | Howard et al. |
| 3,364,993 | A | | 1/1968 | Skipper |
| 4,723,579 | A | | 2/1988 | Hyodo et al. |
| 4,810,453 | A | | 3/1989 | Clarke et al. |
| 4,865,127 | A | | 9/1989 | Koster |
| 5,167,258 | A | | 12/1992 | Rice |
| 5,172,730 | A | | 12/1992 | Driver |
| 5,233,304 | A | * | 8/1993 | Hubans ..... 324/323 |
| 5,236,047 | A | * | 8/1993 | Pringle et al. ..... 166/369 |
| 5,390,742 | A | * | 2/1995 | Dines et al. ..... 166/297 |
| 5,395,472 | A | | 3/1995 | Mandich |
| 5,503,695 | A | | 4/1996 | Imoto et al. |
| 5,546,992 | A | | 8/1996 | Chick et al. |
| 5,551,484 | A | | 9/1996 | Charboneau |
| 5,563,512 | A | * | 10/1996 | Mumby ..... 324/339 |
| 5,833,001 | A | * | 11/1998 | Song et al. ..... 166/287 |
| 5,873,391 | A | | 2/1999 | Kittson et al. |
| 6,015,015 | A | | 1/2000 | Luft et al. |
| 6,105,619 | A | | 8/2000 | Kiest, Jr. |
| 6,196,271 | B1 | | 3/2001 | Braun et al. |
| 6,250,385 | B1 | | 6/2001 | Montaron |

(Continued)

FOREIGN PATENT DOCUMENTS

| | | |
|---|---|---|
| GB | 2347950 | 9/2000 |

(Continued)

*Primary Examiner*—James F Hook
(74) *Attorney, Agent, or Firm*—Patterson & Sheridan, LLP

(57) ABSTRACT

A method of lining a bore section, the method comprises providing a first tubing section and an expandable thin-walled second tubing section. The first tubing section is run into a section of a bore. The second tubing section is then run into the bore section, within the first tubing section, and expanded to a larger diameter, such that the bore section is lined by at least two tubing sections.

30 Claims, 2 Drawing Sheets

U.S. PATENT DOCUMENTS

| | | | | |
|---|---|---|---|---|
| 6,283,209 | B1 | 9/2001 | Keller | |
| 6,305,427 | B1 | 10/2001 | Priest, II | |
| 6,311,730 | B2 | 11/2001 | Penza | |
| 6,405,800 | B1 * | 6/2002 | Walker et al. | 166/278 |
| 6,612,340 | B1 | 9/2003 | Lause | |
| 6,614,229 | B1 * | 9/2003 | Clark et al. | 324/338 |
| 6,634,388 | B1 | 10/2003 | Taylor et al. | |
| 6,688,395 | B2 | 2/2004 | Maguire et al. | |
| 6,708,767 | B2 | 3/2004 | Harrall et al. | |
| 6,942,029 | B2 | 9/2005 | Simpson | |
| 2003/0047322 | A1 | 3/2003 | Maguire et al. | |
| 2004/0069499 | A1 * | 4/2004 | Cook et al. | 166/380 |
| 2004/0221996 | A1 | 11/2004 | Burge | |
| 2005/0173108 | A1 | 8/2005 | Cook | |

FOREIGN PATENT DOCUMENTS

| | | |
|---|---|---|
| GB | 2347952 | 9/2000 |
| GB | 2382368 | 7/2001 |
| WO | WO 97/17524 | 5/1997 |
| WO | WO 00/50732 | 8/2000 |
| WO | WO 00/50733 | 8/2000 |
| WO | WO 00/77431 | 12/2000 |
| WO | WO 01/04535 | 1/2001 |
| WO | WO 02/29199 | 3/2002 |

* cited by examiner

BORE-LINING TUBING

CROSS-REFERENCE TO RELATED APPLICATIONS

This application is a divisional of U.S. patent application Ser. No. 10/115,434, filed Apr. 3, 2002, now abandoned which claims benefit of Great Britain application number GB 0108384.9 filed Apr. 4, 2001. Each of the aforementioned related patent applications is herein incorporated by reference.

FIELD OF THE INVENTION

This invention relates to bore-lining tubing and to bores lined with such tubing. The invention also relates to methods of expanding bore-lining tubing downhole.

BACKGROUND OF THE INVENTION

The oil and gas exploration and production industry is making increasing use of expandable tubing for use as bore-lining casing and liner, as well as in straddles and in sand screens. The primary advantage of such tubing is that it can be run through a restriction, such as an existing cased section of bore, and then expanded to a diameter corresponding to the existing casing section. It is anticipated that this will permit the creation of "monobore" wells; that is wells having a bore of substantially constant diameter, in contrast to current wells in which the well diameter tends to decrease from surface in a stepwise fashion.

It is among the objectives of embodiments of the present invention to provide a method of lining a bore utilizing a plurality of coaxial expandable tubes.

SUMMARY OF THE INVENTION

According to a first aspect of the present invention, there is provided a method of lining a bore section, the method comprising:

providing an expandable first tubing section and an expandable second tubing section;

running the first tubing section into a section of a bore;

expanding the first tubing section to a larger diameter;

running the second tubing section into said bore section, within the expanded first tubing section; and expanding the second tubing section to a larger diameter such that said bore section is lined by at least two expanded tubing sections.

The invention also relates to a wellbore created using this method, and to the apparatus utilized to line bores in accordance with the method.

The method of the invention offers many advantages over conventional expandable tubing bore-lining methods, whereby a bore section is lined with only a single expanded tubing section. The only parts of such a conventional bore where two expanded tubing sections are present are where adjacent tubing sections overlap, where it is generally necessary for the overlapping tubing sections to be expanded simultaneously, to prevent a step-change in internal bore diameter at the overlap.

The present invention allows relatively thin-walled tubing to be utilized to line a bore. The combination of two or more relatively thin-walled tubing sections tends to create a composite bore-lining of equivalent or greater strength than a single section of relatively thick-walled tubing. Of course it is also possible to build up an expanded composite wall, incorporating two, three, or more tubing sections of considerable thickness. It has also been found that in such a composite expanded tubing liner the resistance of the expanded inner tubing section to external crushing forces, such as would be produced by an elevated external pressure, is surprisingly high. The invention also permits a bore lining to be composed of tubing sections of different materials or different structures, for example an outer tubing section of relatively inexpensive material may be lined with a relatively thin inner tubing section of more expensive corrosion-resistant material, rather than providing a single relatively thick-walled and thus expensive tubing section of the corrosion-resistant material. In other embodiments a tubing section of relatively inexpensive material may be sandwiched between two tubing sections of more expensive corrosion resistant materials. Alternatively, or in addition, an outer expanded slotted tubing section may be lined with an inner solid walled inner tubing section, to provide a fluid-tight composite expanded liner which will withstand elevated external fluid pressure forces. Of course the relative positions of the tubing sections could be reversed, with the solid walled tubing being located externally of the slotted tubing. In other embodiments one or more of the tubing sections may be of non-metallic material, typically a polymeric material. For example, polyurethane tubing, as sold under the Polybore™ trademark, may be run into a bore section, the tubing expanding into contact with the surrounding casing in response to the elevated temperatures experienced downhole. It is known to use such tubing to line and seal existing casing which has been subject to erosion or corrosion; however, the expanded polyurethane tubing only has limited strength to resist external pressure or crush forces. However, utilizing the present invention, a length of expandable metallic solid-walled tubing may be run in and then expanded into contact with the previously expanded polyurethane tubing, and so provide the polyurethane tubing with internal support. In still further embodiment, a section of open bore may be initially lined with thin-walled tubing to prevent lost circulation. The bore may then be lined with a corrugated tubing to provide enhanced crush resistance, which is resistance to external pressure forces. The corrugated tubing may be corrugated axially, helically, or circumferentially. Subsequently, an inner lining of thin-walled tubing may be installed to provide a smooth internal bore wall. During the installation of the inner tubing, the expansion of the inner tubing may be such that the corrugated tubing is flattened or at least partially flattened. However, it may be desired to retain voids within the bore wall to provide, for example, enhanced insulation or to permit fluid circulation axially through the bore-lining between the inner and outer tubing.

As noted above, one of the primary advantages of embodiments of the present invention is that composites or laminates of relatively thin tubing, which is therefore relatively lightweight and flexible, may be utilized for lining bores. Conventional casing and liner typically ranges in wall thickness from 6 mm to 20 mm, depending on tubing diameter, material, and application. However, the present invention allows use of thinner tubing, which is tubing having a wall thickness of less than 6 mm and preferably around 3 mm to 4 mm.

Conventional expanded tubing has tended to be formed of extruded tubing, which is relatively expensive and time consuming to produce. However, with the benefit of the present invention tubing sections of rolled and welded sheet metal may be utilized. The potential or perceived weak point of the tubing, at the welded joint, is protected and supported by the tubing sections located internally or externally of the welded tubing. Where two or more welded tubing sections are utilized, the weld locations of the different tubing sections may be circumferentially spaced apart.

Of course, relatively a thin tubing section generally requires application of lower forces to expand the tubing, facilitating the expansion operation, and providing greater freedom in the range of bores in which expanded tubing may be provided, and the apparatus and methods used to run in and expand the tubing. Each tubing section may also be of relatively light weight, facilitating the handling and running of the tubing, particularly when dealing with larger tubing diameters. For example, running conventional larger diameter casing involves many difficulties, due primarily to the weight of the casing and the large frictional forces that may be encountered. By replacing such casing with a composite expanded casing many of these difficulties may be avoided: the individual tubing sections are lighter and initially of a smaller diameter, and are therefore easier to run into a bore, and may be rotated to facilitate overcoming obstacles in the bore and to facilitate cementing. The reduction in weight of the tubing also facilitates the running of longer tubing sections. In one embodiment, a bore may be initially lined with a number of separately run tubing sections, and then a final tubing section run into the bore, which tubing section may carry conduits or conductors as described below, and expanded to line substantially the entire length of the bore.

The invention also facilitates provision of bore-linings having particular desirable properties or features. For example, by locating a heat-insulating material or arrangement between expanded first and second tubing sections it may be possible to maintain fluid flowing through the tubing at relatively high temperatures, which may be useful in avoiding separation or precipitation of different fractions in certain formation fluids. Tubing sections may be electrically insulated or electrically coupled to permit signals or power to be transmitted via the bore-lining. Alternatively, or in addition, separate conductors or conduits may be located or sandwiched between first and second expanded tubing sections, or may be incorporated into a tubing section. The conductors or conduits may be encapsulated in a polymer or elastomer sheath on the inner tubing section. Alternatively, or in addition, the conductors or conduits may be incorporated or encapsulated in a separate expandable polymeric or elastomer tube. Such conduits or conductors may include electrical wiring, fiber optic cables, or fluid conduits. In the interests of brevity, the term "conduit" may be used herein as indicative of any of such conduits or conductors. In other embodiments, abutting surfaces of adjacent tubing sections may define channels such that the composite tubing defines fluid conduits between the tubing sections.

Where electrical conductors are provided, these may be arranged to define, for example, coils or windings which may be utilized as stators for electric motors or for the inductive transfer of power or information. Conductors or magnets could also be provided to form a linear motor in the tubing.

A difficulty which is present in the proposed monobore wells created using conventional expandable tubing is mentioned above, that is the requirement to expand the overlapping ends of adjacent tubing sections simultaneously. A further difficulty arises when the previously expanded tubing has been cemented, and the cement has set, as it is difficult if not impossible to expand cemented tubing. Using the present invention, these difficulties may be avoided as it is no longer necessary to overlap the ends of adjacent tubing sections to create a seal. Outer tubing sections may be located end-to-end in the bore, without overlap, and inner tubing sections then run in and expanded with the ends of the inner tubing sections spaced from the ends of the outer sections. The contact between the inner and outer tubing sections may be itself sufficient to provide the necessary sealing between the bore wall and the interior of the composite tubing, and indeed seal arrangements may be provided between the inner and outer tubing sections to provide a barrier to fluid flow between the tubing sections. Alternatively, or in addition, the outer tubing sections may be provided with end portions which may be overlapped, which end portions may be relatively thin-walled or of relatively flexible material, or which end portions may be removed before location of the inner tubing sections in the bore, or which end portions may be accommodated by deformation or profiling of the inner tubing sections.

The ability to utilize relatively thin-walled tubing sections provides greater flexibility in the form of the tubing sections, in that where a conventional bore-lining operation may have required use of relatively heavy jointed tubing, the invention facilitates use of lighter reelable tubing, and also the use of "C-shaped" or flattened tubing which is run into the bore in a folded or flattened form and then subsequently unfolded, and possibly then further expanded.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
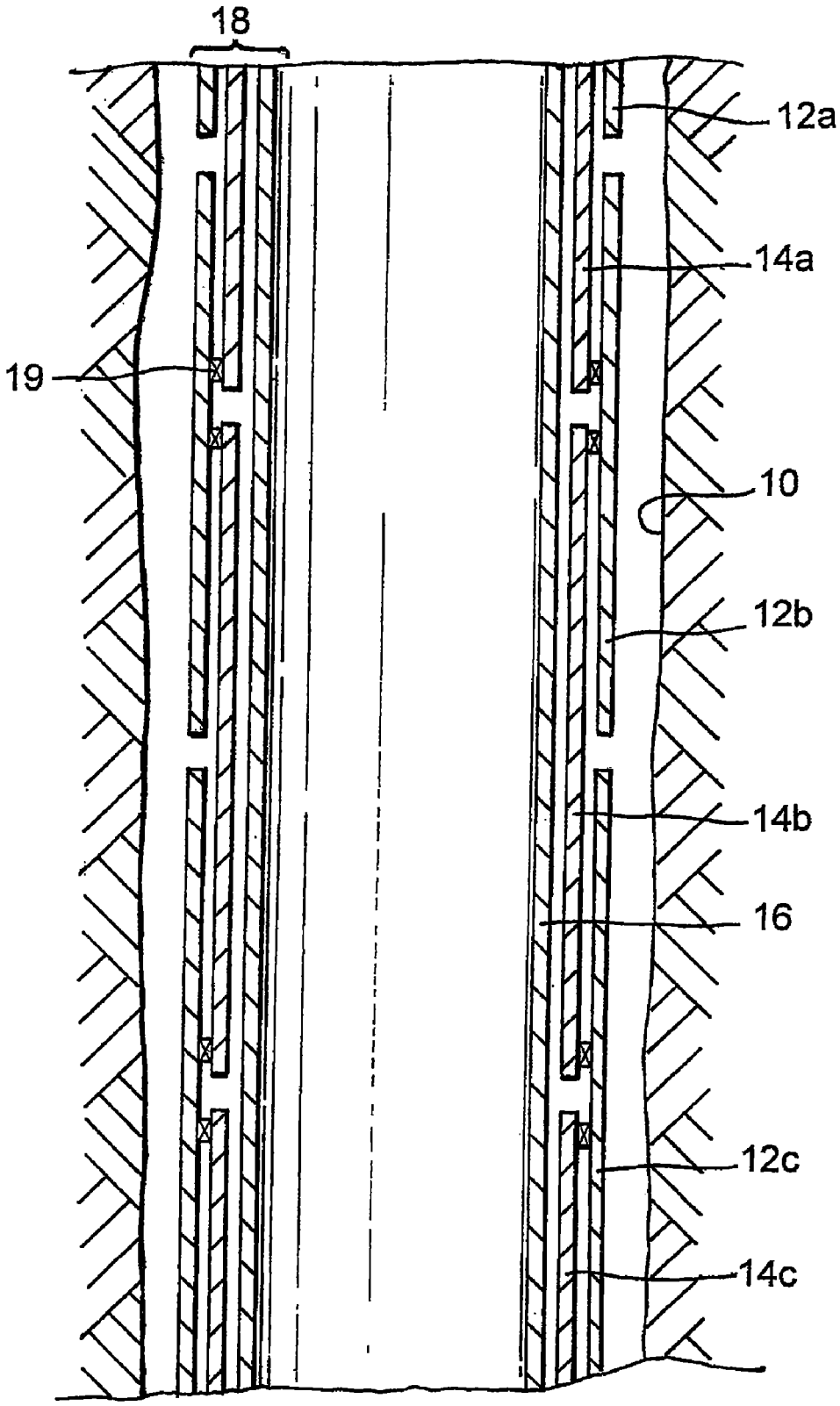
FIG. 1 is a schematic sectional view of a composite tubing-lined wellbore in accordance with an embodiment of the present invention.

Reference is first made to FIG. 1 of the drawings, which illustrates a drilled bore 10 which has been lined with expandable metal tubing, in accordance with a method of an embodiment of the present invention. In particular, the bore 10 has been lined with a series of outer tubing sections 12*a*, 12*b*, 12*c*, intermediate tubing sections 14*a*, 14*b*, 14*c*, and an inner tubing section 16. Together, the various tubing sections 12, 14, 16 form a composite bore-lining casing 18.

The casing 18 is created as described below. Following the drilling of the bore 10, a first outer tubing section 12*a* is introduced into the bore 10, in an unexpanded, smaller diameter configuration. The tubing section 12*a* is run into the desired location in the bore 10 and then expanded to a larger diameter, as illustrated in FIG. 1. The tubing section 12*a* may also be cemented in the bore 10. A second outer tubing section 12*b* is then run into the bore 10, in unexpanded condition, and located below the first outer tubing section 12*a*. The second tubing section 12*b* is then expanded to a diameter corresponding to the diameter of the first tubing section 12*a*. As will be noted from FIG. 1, the ends of the tubing sections 12*a*, 12*b* do not overlap; rather, the sections 12*a*, 12*b* are positioned in end-to-end relationship. Depending on bore conditions a further tubing section 12*c* may be run in and expanded, below the tubing section 12*b*.

Once the outer tubing sections 12*a*, 12*b*, 12*c* are in place, a first intermediate tubing section 14 is run into the bore, in unexpanded condition, and then expanded to engage the inner wall of the tubing section 12*a* (to allow the different tubing sections to be more readily identified, the figures shown the tubing sections are spaced apart). Seals 19 are provided towards the end of the tubing section 14*a*, such that when the tubing section 14*a* is expanded into contact with the outer tubing section 12*a*, the seals 19 create a barrier to fluid movement between the tubing sections 12*a*, 14*a*. This process is then repeated with the further intermediate tubing sections 14*b*, 14*c*, and it will be noted that the seals 19 ensure that there is no fluid path between the bore wall 10 and the interior of the intermediate tubing sections 14*a*, 14*b*, 14*c*.

As the bore 10 is drilled deeper, further outer and intermediate tubing sections 12, 14 may be run into the bore 10 and expanded, to line and isolate the bore wall. Once the drilling of the bore 10 has been completed, and all of the appropriate tubing sections 12, 14 run in and expanded, the continuous inner tubing section 16 is run into the bore in unexpanded condition, and then expanded into contact with the inner face of the intermediate tubing sections 14.

Figure 2:
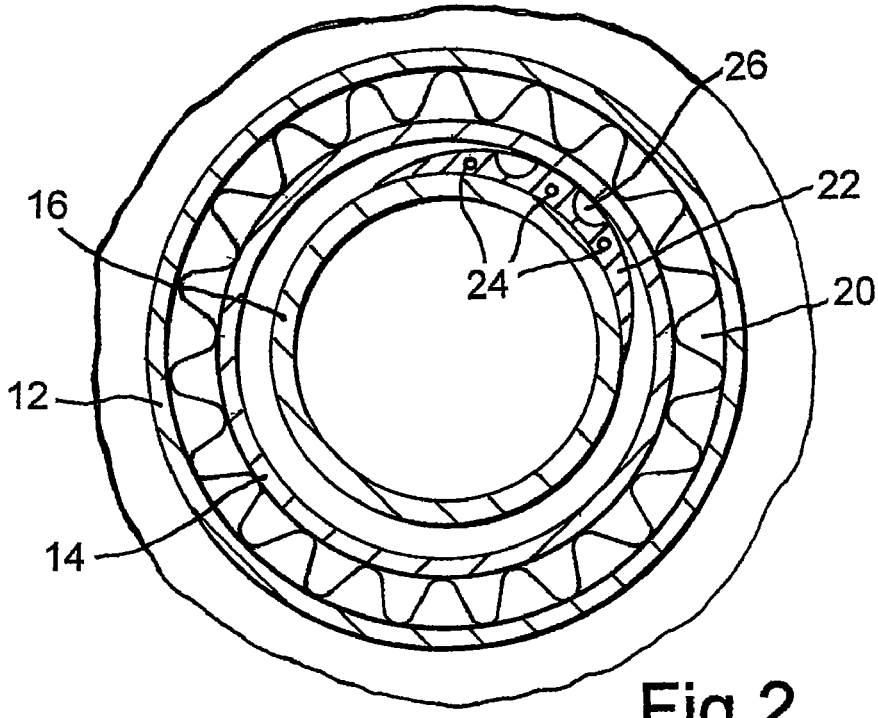
FIG. 2 is a sectional view of a part of the wellbore of FIG. 1.

Reference is now also made to FIG. 2 of the drawings, which shows a cross-section view of the lined bore. At the location of this section, the intermediate tubing section 14 has been provided with a sleeve 20 of an insulating material, which is sandwiched between the tubing sections 12, 14 on expansion of the intermediate tubing section 14. This assists in maintaining the temperature of formation fluids being removed from the bore.

In addition, it will be noted that the inner tubing section 16 carries a crescent-shaped segment of elastomeric material 22 defining, in this example, three conduits 24 and two channels 26. The conduits 24 may be utilized to transfer fluids, or may contain signal-carrying elements, such as wiring or optical fibers. The channels 26 may be used to carry fluids, as when the inner tubing 16 is expanded the segment 22 will engage the intermediate tubing section 14, and thus close the channel 26.

In this example, the inner tubing section 16 is formed of a reelable tubing section, such that the conduits 24 and channels 26 may be continuous over the length of the tubing section 16. Where jointed tubing is used, it may be more convenient to provide the individual tubing joints with a profile such as profile 22 illustrated in FIG. 2, or alternatively a sheath provided with channels or slots into which cables, conductors, or other signal carriers may be located as the tubing is being run into the bore, rather than attempting to make the conduits integral with the tubing.

Figure 3:
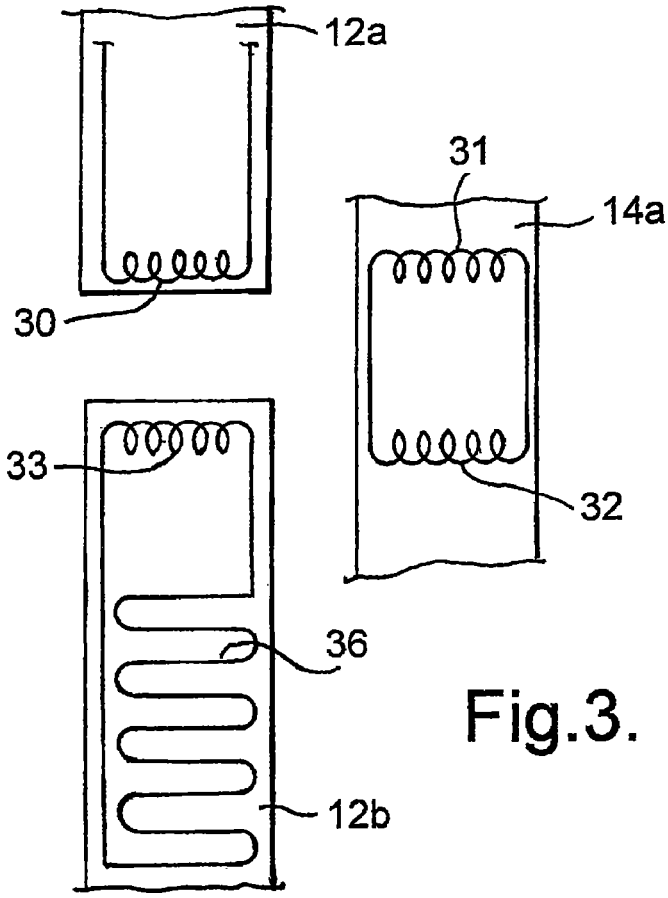
FIG. 3 is a schematic illustration of a feature of the bore-lining tubing of FIG. 1.

An alternative arrangement for providing communication between jointed tubing sections is illustrated schematically in FIG. 3 of the drawings. In this illustration, overlapping tubing sections 12*a*, 14*a*, 12*b* incorporate electrical conductors which are formed into coils 30, 31, 32, 33. The coils are located such that where the expanded tubing sections overlap, the coils 30, 31 and 32, 33 are adjacent one another, such that there may be inductive transfer of energy between the coils allowing transfer of energy in the absence of any direct physical connection.

The conductor in the tubing section 12*b* is illustrated as being formed into a further coil or winding 36, which is arranged to form the stator of an electric motor to be used to drive an electric submersible pump (ESP). Thus, it is possible to run in a pump body containing only the pump rotor for use in combination with the stator 36 which has already been located in the bore lining. Of course in such an arrangement it would be necessary for the inner tubing 16 to be formed of non-magnetic material.

In other embodiments, the coil 36 could be utilized for inductively charging downhole apparatus, such as a downhole autonomous tractor to allow extended operation downhole and also permitting inductive transfer of information to surface.

It will be apparent to those of skill in the art that the above-described embodiments are merely exemplary of the present invention, and that many further modifications and improvements may be made to the illustrated embodiment without departing from the scope of the present invention. For example, in the illustrated embodiment the various tubing sections all have solid walls and in other embodiments one or more of the tubing sections could be slotted. Further, in other embodiments the composite casing may comprise only two expanded tubing sections or indeed four or more tubing sections. Also, a number of the features mentioned above may be utilized in bores where a single tubing section is expanded within an existing tubing section, which may or may not have previously been expanded. The invention also applies to tubing which will expand without external intervention, for example certain materials will expand on exposure to the elevated temperatures experienced in deep bores. Such materials, such as the reelable tubing sold under the Polybore™ trademark, may have limited physical strength, but can provide useful fluid barriers and may be sandwiched between structural tubing.

The invention claimed is:

1. A method of lining a wellbore, the method comprising:

lowering a first tubular into the wellbore;

expanding the first tubular into contact with the wellbore;

lowering a second tubular into the wellbore to a location below the first tubular, leaving an axial separation between the first tubular and the second tubular;

expanding the second tubular into contact with the wellbore;

lowering a third tubular into the wellbore and positioning the third tubular adjacent the axial separation;

expanding the third tubular into contact with the first tubular and the second tubular, thereby covering the axial separation; and positioning and expanding an inner tubular within the wellbore such that a portion of the inner tubular overlaps a portion of the first tubular, the second tubular and the third tubular.

2. The method of claim 1, wherein the first tubular, the second tubular and the third tubular are selected from the group consisting of a solid-walled tubular, slotted tubular, corrugated tubular, and combinations thereof.

3. The method of claim 1, wherein the inner tubular includes a conduit formed in a shaped segment of elastomeric material disposed on an exterior surface thereof.

4. The method of claim 3, wherein the conduit includes at least one of electrical wiring, fiber optic cables, and pressure conduits.

5. The method of claim 3, wherein the conduit is encapsulated in a polymeric element.

6. The method of claim 3, wherein a channel is formed within the shaped segment of elastomeric material.

7. The method of claim 6, wherein the channel is configured to close upon expansion of the inner tubular within the wellbore.

8. The method of claim 1, wherein a sealing material is disposed about an upper portion and lower portion of the third tubular.

9. The method of claim 1, further comprising lowering a fourth tubular into the wellbore to a location below the second tubular and leaving a second axial separation between the second tubular and the fourth tubular.

10. The method of claim 9, further comprising expanding the fourth tubular into contact with the wellbore.

11. The method of claim 10, further comprising positioning a fifth tubular adjacent the second axial separation and expanding the fifth tubular into contact with the second and fourth tubulars.

12. The method of claim 1, wherein the inner tubular is positioned and expanded in the wellbore such that a portion of the wellbore is lined with at least three layers of tubulars.

13. A method of lining a wellbore, the method comprising:

lowering a first tubular into the wellbore below a preexisting wellbore tubular and leaving an axial separation between the tubulars;

expanding the first tubular into contact with the wellbore;

lowering a second tubular into the wellbore and positioning the second tubular adjacent the axial separation;

expanding the second tubular into contact with the preexisting wellbore tubular and the first tubular, thereby covering the axial separation; and positioning and expanding an inner tubular within the wellbore such that a portion of the inner tubular overlaps at least a portion of the first tubular and the second tubular.

14. The method of claim 13, wherein the preexisting wellbore tubular is a string of casing lining the wellbore.

15. The method of claim 13, wherein at least one of the tubing sections is slotted.

16. The method of claim 13, further comprising lowering a third tubular into the wellbore below the first tubular and leaving an axial separation between the first tubular and the third tubular.

17. The method of claim 16, further comprising expanding the third tubular into contact with the wellbore.

18. The method of claim 17, further comprising positioning a fourth tubular adjacent the axial separation and expanding the fourth tubular into contact with the first and third tubulars, thereby covering the axial separation.

19. The method of claim 13, wherein at least one of the tubulars defines a linear motor.

20. The method of claim 13, further comprising maintaining the axial separation after the expansion of the second tubular.

21. The method of claim 13, further comprising transmitting a signal via at least one of the tubulars, whereby at least one of the tubulars is electrically conducting and is electrically insulated.

22. The method of claim 13, wherein abutting surfaces of adjacent tubulars define channels such that fluid conduits are defined between the tubulars.

23. The method of claim 13, wherein the inner tubular is positioned and expanded in the wellbore such that a portion of the wellbore is lined with the first tubular, the second tubular and the inner tubular.

24. An apparatus for use in lining a bore, the apparatus comprising:

a plurality of first tubing sections adapted for location in a bore section with an axial separation between the first tubing sections, wherein each first tubing section is configured to have a first diameter prior to expansion and a second larger diameter after expansion;

an expandable second tubing section adapted for location in the bore within the first tubing sections and bridging the axial separation between the first tubing sections and for expansion therein; and an expandable inner tubing section adapted for location in the bore such that a portion of the expandable inner tubing section overlaps a portion of the plurality of first tubing sections and a portion of the expandable second tubing section.

25. The apparatus of claim 24, wherein at least one of the tubulars defines a linear motor.

26. The apparatus of claim 24, wherein at least one of the tubulars includes a heat-insulating material or arrangement.

27. The apparatus of claim 24, wherein at least one of the tubulars is electrically conducting and is electrically insulated to permit at least an electrical signal to be transmitted thereby.

28. The apparatus of claim 24, wherein abutting surfaces of adjacent tubulars define channels such that fluid conduits are defined between the tubulars.

29. The apparatus of claim 24, wherein a portion of the bore is concurrently lined with at least one first tubing section, the expandable second tubing section and the expandable inner tubing section.

30. A method of lining a wellbore, the method comprising:

positioning and expanding a first outer tubular into contact with the wellbore, wherein the first outer tubular includes a first electrical conductor;

positioning and expanding a second outer tubular into contact with the wellbore below the first tubular, leaving an axial separation between the first outer tubular and the second outer tubular, wherein the second outer tubular includes a second electrical conductor; and positioning and expanding an intermediate tubular adjacent the axial separation, thereby covering the axial separation, wherein the intermediate tubular includes an intermediate electrical conductor that is configured to connect the first electrical conductor to the second electrical conductor.

* * * * *